US006740458B1

(12) United States Patent
D'Offay

(10) Patent No.: US 6,740,458 B1
(45) Date of Patent: May 25, 2004

(54) PHOTOGRAPHIC PRINTMAKING METHOD

(76) Inventor: Caroline D'Offay, 632 N. Glenwood, #3, Chicago, IL (US) 60660

( * ) Notice: Subject to any disclaimer, the term of this patent is extended or adjusted under 35 U.S.C. 154(b) by 4 days.

(21) Appl. No.: 10/217,280

(22) Filed: Aug. 12, 2002

(51) Int. Cl.[7] ..... G03C 5/20
(52) U.S. Cl. ..... 430/9; 430/139
(58) Field of Search ..... 430/9, 139

(56) References Cited

U.S. PATENT DOCUMENTS

| | | | | |
|---|---|---|---|---|
| 2,303,942 A | * | 12/1942 | Lane et al. | 430/139 |
| 2,321,046 A | * | 6/1943 | Rudnick | 430/139 |
| 2,327,826 A | * | 8/1943 | Sherwood | 430/139 |
| 3,959,800 A | | 5/1976 | Friedel | |
| 4,440,840 A | | 4/1984 | Yamaguchi | |
| 4,745,286 A | | 5/1988 | Jones | |
| 4,879,097 A | | 11/1989 | Whitehead et al. | |
| 5,902,670 A | | 5/1999 | Ripstein | |
| 6,008,269 A | | 12/1999 | Kitagawa et al. | |
| 6,057,639 A | | 5/2000 | May et al. | |
| 6,207,077 B1 | | 3/2001 | Burnell-Jones | |
| 6,233,857 B1 | | 5/2001 | Wyckoff et al. | |
| 6,240,664 B1 | | 6/2001 | Hjaltason | |
| 6,335,522 B1 | | 1/2002 | Shimada et al. | |
| 6,344,364 B1 | | 2/2002 | Gilton | |

* cited by examiner

*Primary Examiner*—John A. McPherson
(74) *Attorney, Agent, or Firm*—Mayer, Brown, Rowe & Maw LLP

(57) ABSTRACT

A printmaking process that utilizes phosphorescent transfer plates as the method for producing prints is disclosed. Specifically, this invention uses an engraved plate, which is coated with viscous phosphorescent paint. Once the paint on the plate is dry, the plate is exposed to light, causing the paint to become light-emitting. The plate is then placed in contact with photo-sensitive emulsion. After the proper exposure time, the photo-sensitive emulsion is developed, thereby producing a print. This invention can generate a wide array of prints. For example, black and white prints can be created under this invention. Further, prints containing a variation of tones between black and white and/or prints containing texture can be manufactured under this invention. Finally, color prints can be produced under this invention.

27 Claims, 13 Drawing Sheets

PHOTOGRAPHIC PRINTMAKING METHOD

FIELD OF INVENTION

This invention relates to a method of printmaking, and more specifically a method of printmaking that utilizes an engraved plate, which is then coated with viscous phosphorescent paint and placed in contact with a photo-sensitive emulsion, thereby producing a print.

BACKGROUND OF INVENTION

A print is a form of art composed of ink on paper. A print is created not by drawing directly on paper, but rather through an indirect transfer process. The artist begins by creating an image on another surface. After the image is formed, the artist covers that surface with ink. A sheet of paper is then placed in contact with the inked surface and run through a printing press. Due to the pressure exerted by the press, the image is transferred from the surface to the paper, producing a print.

Various printmaking techniques have evolved throughout the years. The three best known techniques are (1) relief printing, (2) intaglio printing, and (3) lithographic printing. While all three techniques produce prints, the way the prints are produced by each technique is unique. Therefore, each technique necessitates a separate discussion.

Relief printing is the oldest, most direct method of printing. In this technique, the artist starts with a block of wood, or other smooth, flat surface. Next, the artist cuts away the entire flat surface, except for the image itself. The raised portion of the surface, which is the image, is then rolled with ink. After the image is inked, a sheet of paper is placed on top of the block and either placed in a press or hand-burnished. The paper is then lifted away from the block and the image appears, in reverse, on the paper.

Contrary to relief printing, in intaglio printing (e.g., etching and engraving) the image is formed below the surface of the plate. The image is hand-cut or acid-etched into a flat, metal plate by the artist. Once the image is complete, the artist spreads inks over the plate. Next, the artist removes the ink from the surface of the plate, leaving only the ink that remains in the incised design. The plate is then placed face-up on an etching press. A sheet of dampened paper is laid on top of the plate, padded with felt blankets, and run through the press. Pressure forces the paper into the etched lines of the image, which consequently produces the image, in reverse, on the paper.

Conversely to both relief printing and intaglio printing, lithographic printing relies on the simple principle of the incompatibility of oil and water. In lithographic printing, an artist creates an image by using oil-based materials on a flat surface while keeping the areas not to be printed wet with water. Next, the artist deposits oil-based ink onto a stone that adheres only to the image. The inked stone is then covered with paper and placed on a lithographic press. The pressure from the press creates the image, in reverse, on the paper.

While relief, intaglio, and lithographic printing are the most popular techniques, all printmaking techniques have been a popular medium in the art world for centuries. Printmaking is a popular medium because it allows an artist to create multiple, almost identical impressions of the same block or plate. Unfortunately, there are a few common characteristics between the different printmaking techniques that currently restrict students, who are constrained by resources, and printmakers from fully exploring and developing the art of printmaking.

First, the current methods of printmaking require a great deal of time. For example, a plate must be re-inked after a print is produced. Also, one press must often be shared by many students and printmakers; and if there is no press, students and printmakers must spend their lime hand-burnishing their prints. Thus, replacing a plate's ink, waiting to use the press, and hand-burnishing a print all consume a great deal of a time—time that could be better spent learning new aspects of printmaking.

Second, the current methods of printmaking require a large volume of expensive printing equipment. For instance, a printing press and lithography chemicals are needed to attain high quality and quantity prints. This requirement restricts both students and printmakers who cannot obtain a printing press and/or lithography chemicals. Moreover, even if the proper equipment can be obtained, the edges of a plate gradually round and collapse due to the high pressure of the press. This rounding and collapsing of the plate lessens the quality of the print over time. Therefore, the constraints posed by the necessary printing equipment greatly restrict both students and printmakers.

Third, even if the proper printing equipment can be obtained, and regularly replaced, the equipment has limitations. For example, tonal variations in prints cannot be obtained in woodcuts. Consequently, students and printmakers must move to metal etchings and lithography, which use a vast number of chemicals and still require an ink application after every print.

Thus, there is a need for an efficient printmaking process so that students and printmakers are not forced to expend their time re-inking a plate, waiting for a press, or hand-burnishing a print. There is a further need for a printmaking method that does not require a high quantity of quality printmaking equipment. Finally, there is a need for a printmaking method that allows students and printmakers to achieve tonal variations in their prints.

SUMMARY OF THE INVENTION

These needs and others may be met by the present invention which has an aspect which is a printmaking method comprised of four main steps. The first step of the method requires that a plate be provided in which one surface of the plate contains cavities that form an image. These cavities can be formed by engraving, etching, or carving into the surface of the plate. The second step of the method requires that a coating of viscous phosphorescent paint be applied over the surface of the plate. The third step of the method requires that the plate be exposed to light and placed in contact with a photo-sensitive emulsion, such as photographic paper or liquid-photographic emulsion. The final step of the method requires that the photo-sensitive emulsion be developed, thereby producing the finished print.

Another aspect of the present invention is a print comprised of a developed photo-sensitive emulsion, which has been exposed to a plate containing an image coated with light-emitting viscous phosphorescent paint. The print can be a black and white print, a black and white print containing tonal variations and/or texture, a monochromatic print, or a color print.

It is to be understood that both the foregoing general description and the following detailed description are not limiting but are intended to provide further explanation of the invention claimed. The accompanying drawings, which are incorporated in and constitute part of this specification, arc included to illustrate and provide a further understanding of the method and system of the invention. Together with the description, the drawings serve to explain the principles of the invention.

BRIEF DESCRIPTION OF DRAWINGS

These and further aspects and advantages of the invention will be discussed more in detail hereinafter with reference to the disclosure of preferred embodiments, and in particular with reference to the appended Figures wherein.

DESCRIPTION OF THE PREFERRED EMBODIMENT

Figure 1:
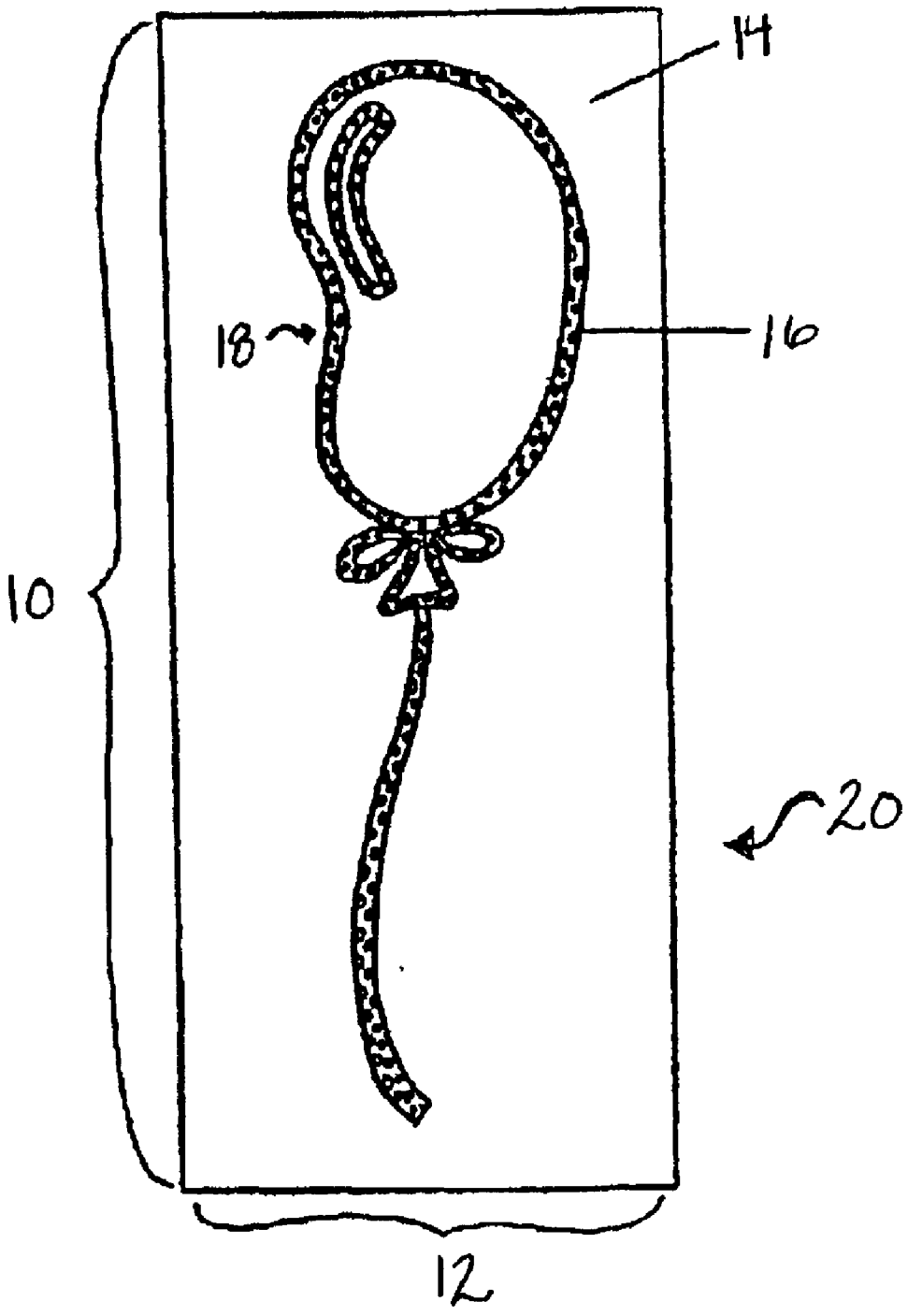
FIG. 1 is a top plan view of an etched plate.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

FIG. 1 shows an example of a wood, metal, stone, or a light, permanently transparent, water-resistant, thermoplastic plate 20 used in conjunction with the present invention. Although the plate 20 may be made of wood, metal, stone, or a light, permanently transparent, water-resistant, thermoplastic, it is preferably made of wood. The plate 20 has a vertical side 10 and a horizontal side 12. The plate also has a plate surface 14 which is generally flat. However, the plate can be etched, engraved, or carved in order to produce cavities 16 in the plate's surface 14. In FIG. 1, the cavities 16 in the plate 20 form the image of a balloon 18.

Figure 2A:
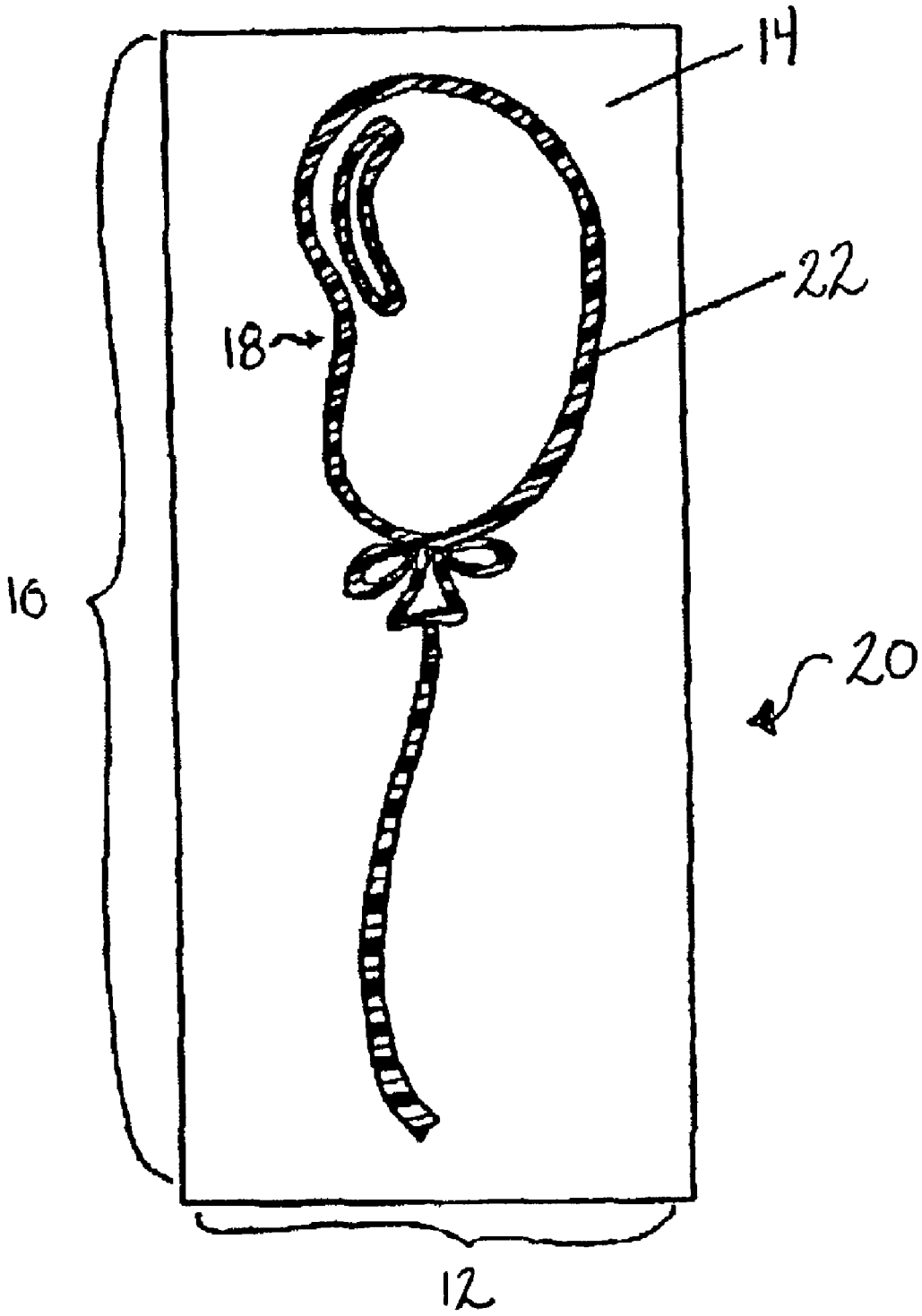
FIG. 2A is a top plan view of an etched plate in which the cavities have been filled, according to the present invention, with viscous phosphorescent paint.

FIG. 2A shows the plate 20 described in FIG. 1 after the uniform application of viscous phosphorescent paint 22 over the plate's surface 14. The viscous phosphorescent paint 22 can be applied with a squeegee, paint brush, putty knife, or any other tool that can force the viscous phosphorescent paint 22 into the plate's cavities 16. All the viscous phosphorescent paint 22 is removed from the plate's surface 14 after application. The viscous phosphorescent paint 22 contained in the plate's cavities 16 is then allowed to dry, and once dried, the paint 22 becomes part of the plate 20. Any viscous phosphorescent paint 22 that remains on the plate's surface 14 is sanded off.

Traditional black and white photo-emulsion surface chemicals: paper developer, stop bath, and fixer, are prepared in a light-proof room under a safelight. The developer is prepared by combining sodium sulfite (CAS#7757-83-7), sodium carbonate (CAS#497-19-8), hydroquinone (CAS#123-31-9), and water. The stop bath is prepared by combining acetic acid and water. The fixer is prepared by combining sodium thiosulfate (7772-98-7), ammonium alum (7784-25-0), sodium metabisulfate (7681-57-4), sodium acetate (127-09-3), boric anhydride (1303-86-2), and water. All of the photo-emulsion surface chemicals are combined in ratios that are specified by traditional black and white developing instructions. However, other chemicals may be used.

Once the traditional black and white photo-emulsion surface chemicals are prepared, the plate 20 is exposed to a light bulb for thirty seconds. Exposing the plate 20 to light causes the viscous phosphorescent paint layer 22 to become light-emitting. To ensure a light-proof environment, the light-emitting plate 20 is removed or shielded from the workspace.

A photo-sensitive emulsion 90, such as photographic paper, or liquid photographic emulsion, is then placed face-up on the workspace. If the photo-sensitive emulsion 90 is flexible, the emulsion is placed on a soft and pliable surface; and if the photo-sensitive emulsion 90 is not flexible, the emulsion is placed on a hard, flat surface. As quickly as possible, the light-emitting plate 20 is placed face-down onto the photosensitive emulsion 90 for fifteen to thirty seconds.

Figure 8:
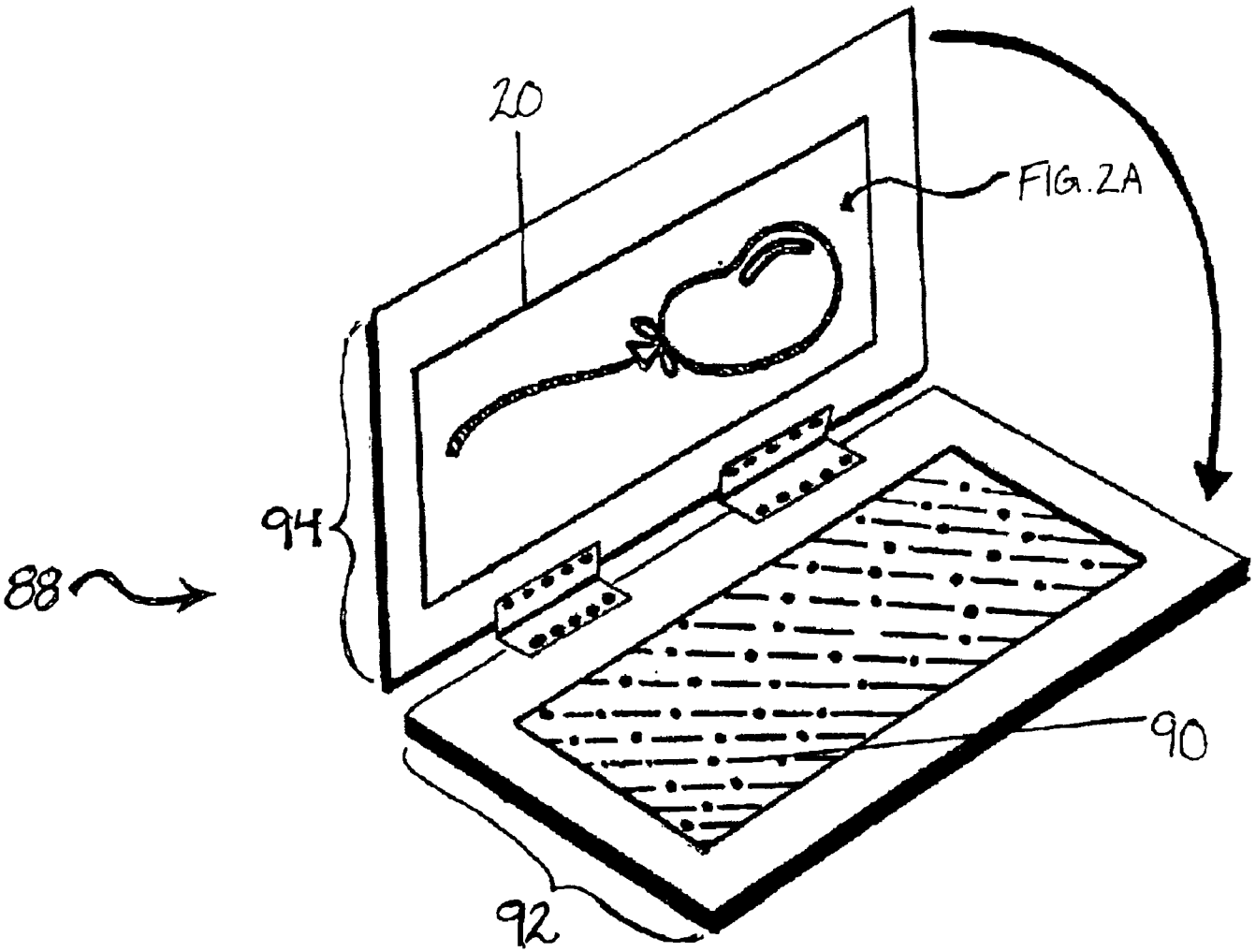
FIG. 8 schematic top view of a hinged device that can be used when making prints according to the present invention.

The photo-sensitive emulsion 90 could also be placed face-up on the bottom component 92 of a hinged device 88 as shown in FIG. 8. The photo-sensitive emulsion 90 is then covered with an opaque substance while the light-emitting plate 20 is placed on the top component 94 of the hinged device 88. Once both the light-emitting plate 20 and the photo-sensitive emulsion 90 are in place, the opaque substance is removed, and the hinged device 88 is closed. The device 88 is closed for fifteen to thirty seconds, depending on the appropriate exposure time.

The exposure time depends on two factors: the whiteness of the photo-sensitive emulsion 90 and the age of the viscous phosphorescent paint. The whiteness of the photo-sensitive emulsion 90 affects the exposure time because light emitted from the plate 20 can be reflected by the photo-sensitive emulsion 90 back onto the plate 20, causing the phosphorescent particles of the paint to recharge. If the phosphorescent particles of the paint are recharged, the exposure time will be altered. The age of the viscous phosphorescent paint 22 also affects the exposure time because as the paint ages its light-emitting strength diminishes. Therefore, testing is done intermittently to determine the proper exposure time.

After the photo-sensitive emulsion 90 is properly exposed to the light-emitting plate 20, the emulsion is developed using the traditional black and white photo-developing instructions. First, the photo-sensitive emulsion 90 is placed in the developer. The developing time for the photo-sensitive emulsion 90 is dependent upon the thickness of the emulsion; more developing time is allotted for thicker emulsions. Second, the photo-sensitive emulsion 90 is placed in the stop bath for thirty seconds. Third, the photo-sensitive emulsion 90 is placed in the fixer. The fixing time for the photo-sensitive emulsion 90 is dependent upon the thickness of the emulsion; more fixing time is allotted for thicker emulsions. Finally, the photo-sensitive emulsion 90 is washed with water and allowed to dry. Once the photo-developing process is complete, the emulsion is no longer light-sensitive.

Figure 2B:
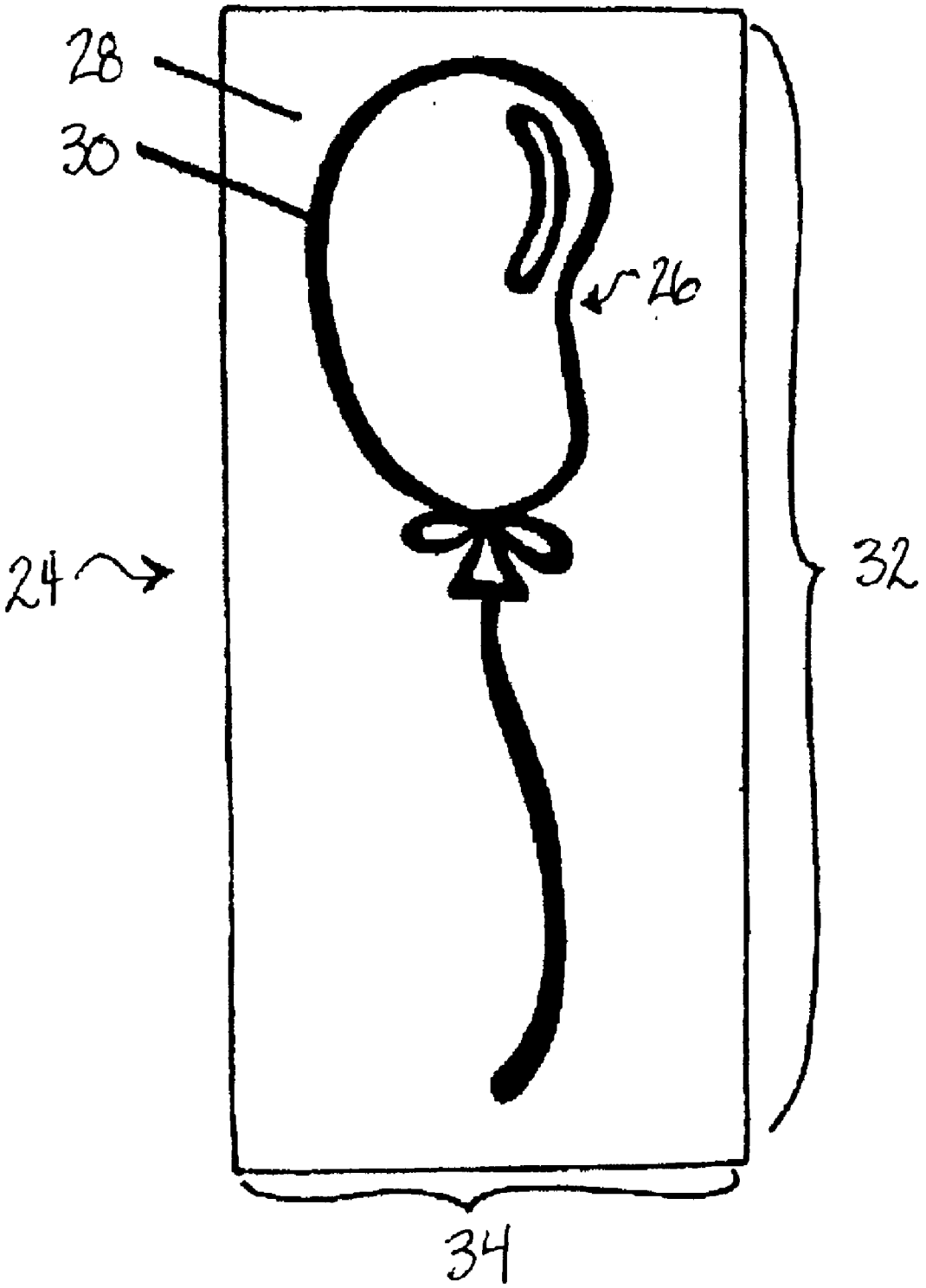
FIG. 2B is a top plan view of the print produced by the plate shown in FIG. 2A.

FIG. 2B shows a print 24 created by the plate 20 shown in FIG. 2A. The print 24 contains a mirror image 26 of the balloon image 18 shown in FIG. 2A. The viscous phosphorescent paint 22 in the plate's cavities 16 (see FIG. 2A) forms the black lines 30 of the print 24 found in FIG. 2B; while the plate's surface 14, which contained no viscous phosphorescent paint 22 (see FIG. 2A) creates the white background 28 of the print 24 as shown in FIG. 2B.

Moreover, the area of the plate 20 and the area of the print 24 are identical. The vertical side of the plate 10 (see FIG. 2A) is the same as the vertical side of the print 32 (see FIG. 2B). Likewise, the horizontal side of the plate 12 (see FIG. 2A) is the same as the horizontal side of the print 34 (see FIG. 2B).

The print 24 is purely black and white as the carved sections 16 of the plate 20 (see FIG. 1) filled with viscous phosphorescent paint 22 will always create black sections 30 in the print 24 (see FIG. 2B). Similarly, a surface without any viscous phosphorescent paint on it will always produce white sections 28 in the print 24. Thus, the plate 20 with phosphorescent paint placed in contact with photo-sensitive emulsion repeatedly reproduces identical black and white prints.

However, because the prints are composed of photographic substances, such as photographic paper, or liquid photographic emulsion, the tone of the finished print can be altered. For example, the prints can be sepia-toned, or tinted with a monochromatic dye.

Figure 3A:
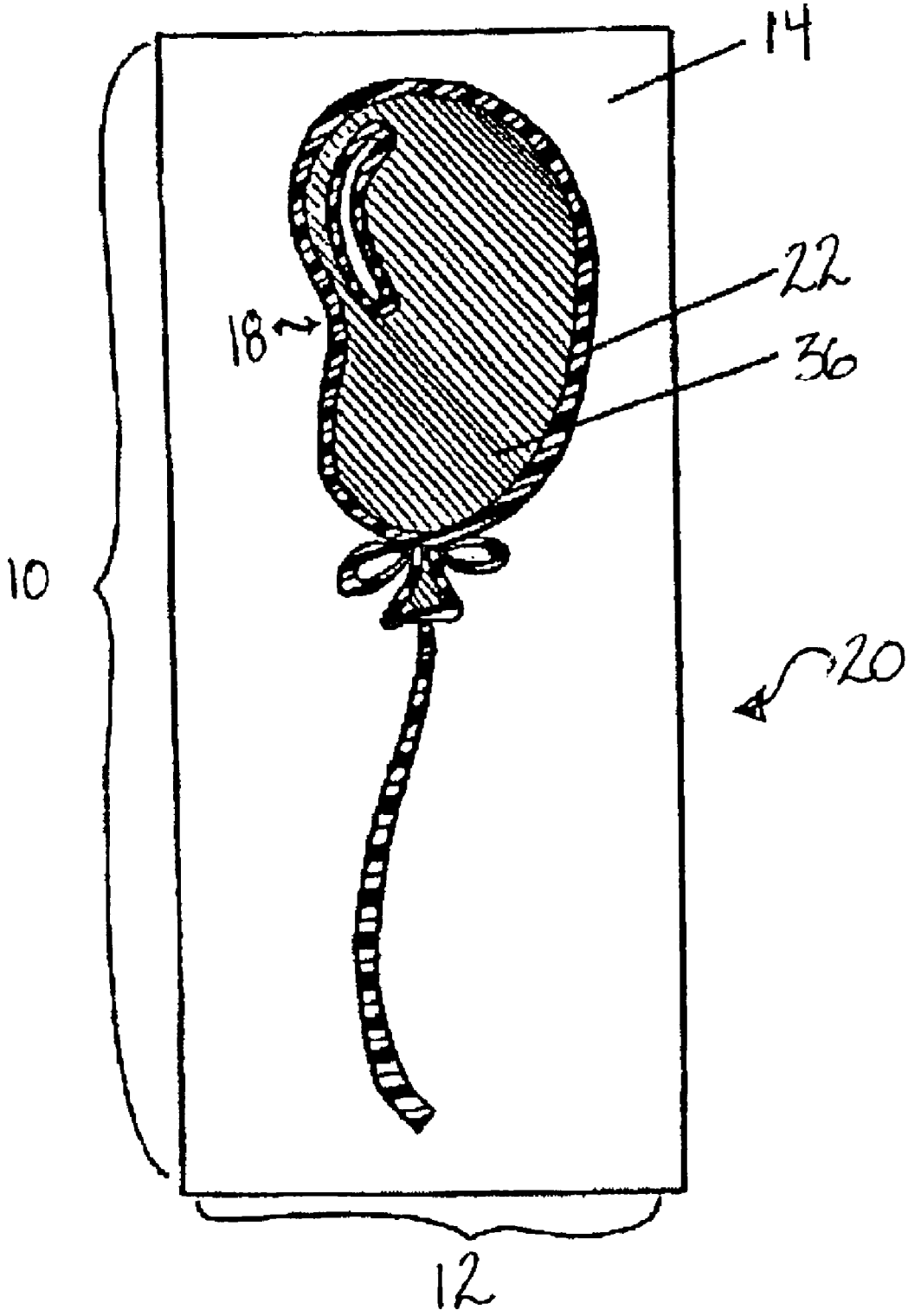
FIG. 3A is a top plan view of an etched plate in which the cavities have been filled and the plate's surface painted, according to the present invention, with viscous phosphorescent paint.

Additionally, a variation of tones between black and white can be achieved using the plate 20 by leaving a thin layer of viscous phosphorescent paint 22 on the plate's surface 14. This thin layer of viscous phosphorescent paint 36 on the plate's surface will yield a gray or mid-tone area 46 in the print 40 (see FIG. 3B). For example, FIG. 3A shows the plate 20 in FIG. 2A, with a thin layer of viscous phosphorescent paint 36 remaining on the plate's surface 14 of the image 18. Alternatively, if no viscous phosphorescent paint remains on the plate's surface 14, the paint can be re-applied to the plate's surface 14 of the image 18 with a paintbrush, sponge, roller, or rag.

As explained above, once the viscous phosphorescent paint 22 & 36 is dry, the plate 20 is exposed to a light bulb causing the viscous phosphorescent paint layers 22 & 36 to become light-emitting. When the light-emitting plate 20 is placed in contact with the photo-sensitive emulsion 90, the image on the plate 20 transfers to the photo-sensitive emulsion 90. The photo-sensitive emulsion 90 is then developed and becomes a print; such as the print 40 shown in FIG. 3B.

Figure 3B:
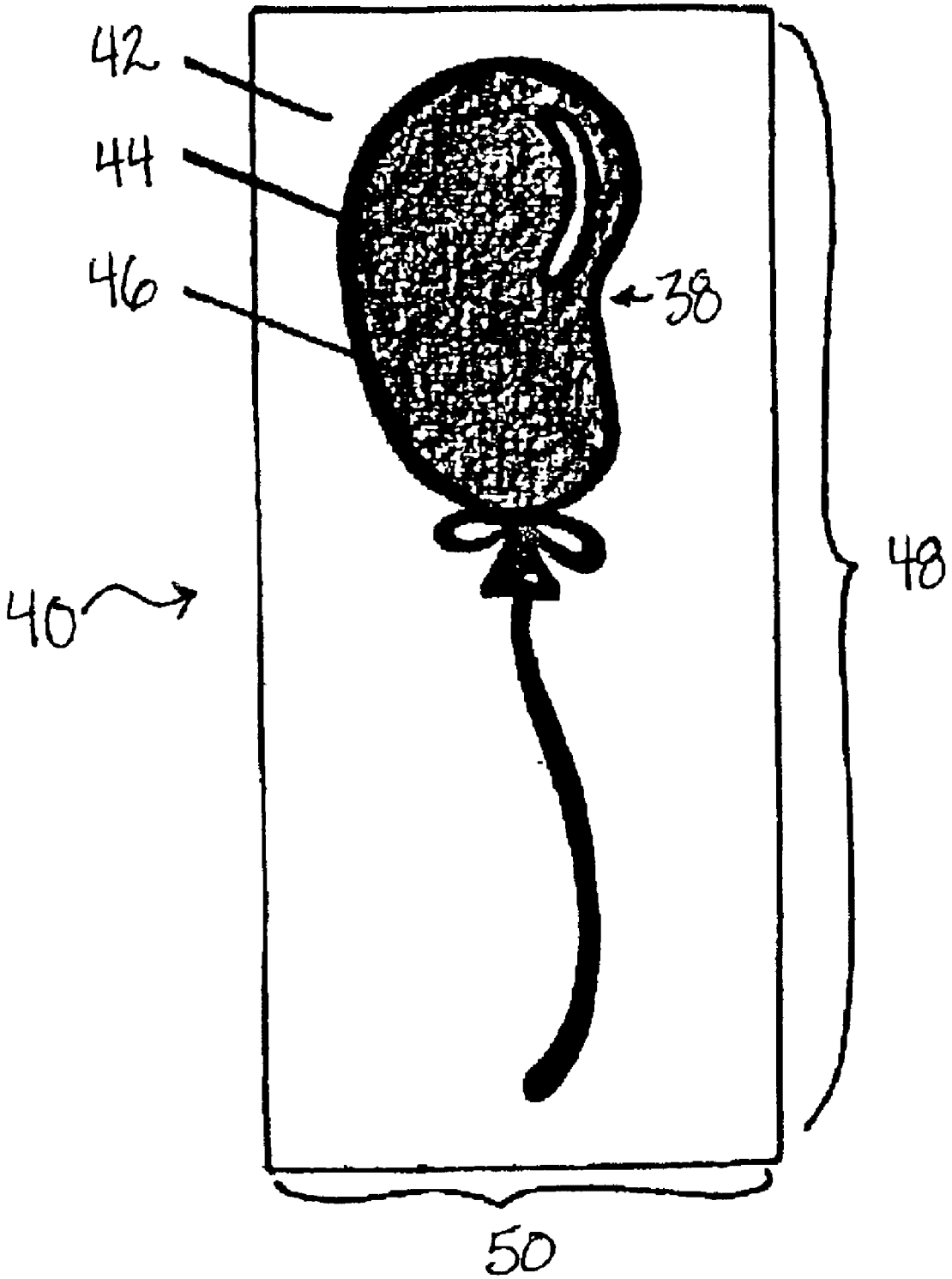
FIG. 3B is a top plan view of the print produced by the plate shown in FIG. 3A.

The print 40 shown in FIG. 3B contains a mirror image 38 of the balloon 18 found in FIG. 3A. The viscous phosphorescent paint 22 found in the plate's cavities 16 (see FIG. 3A) forms the black lines 44 of the print 40 found in FIG. 3B. Moreover, the surface surrounding the image 18, which contains no viscous phosphorescent paint (see FIG. 3A), creates the white background 42 of the print 40 in FIG. 3B. Finally, the viscous phosphorescent paint found on the image's surface 36 (see FIG. 3A) produces a gray tone 46 of the print in FIG. 3B.

In addition, the area of the plate 20 and the area of the print 40 are identical. The vertical side 10 of the plate 20 (see FIG. 3A) is the same as the vertical side 48 of the print 40 (see FIG. 3B). Likewise, the horizontal side 12 of the plate 20 (see FIG. 3A) is the same as the horizontal side 50 of the print 40 (see FIG. 3B). Accordingly, the present invention will repeatedly produce identical black and white prints with tonal variations.

Furthermore, an image's distinctive details, physical composition, and structure ("texture") can be expressed when producing a print 54 under the current invention. Texture can be achieved in a print because the artist is able to etch, engrave, or carve fine cavities into the plate's surface.

Figure 4A:
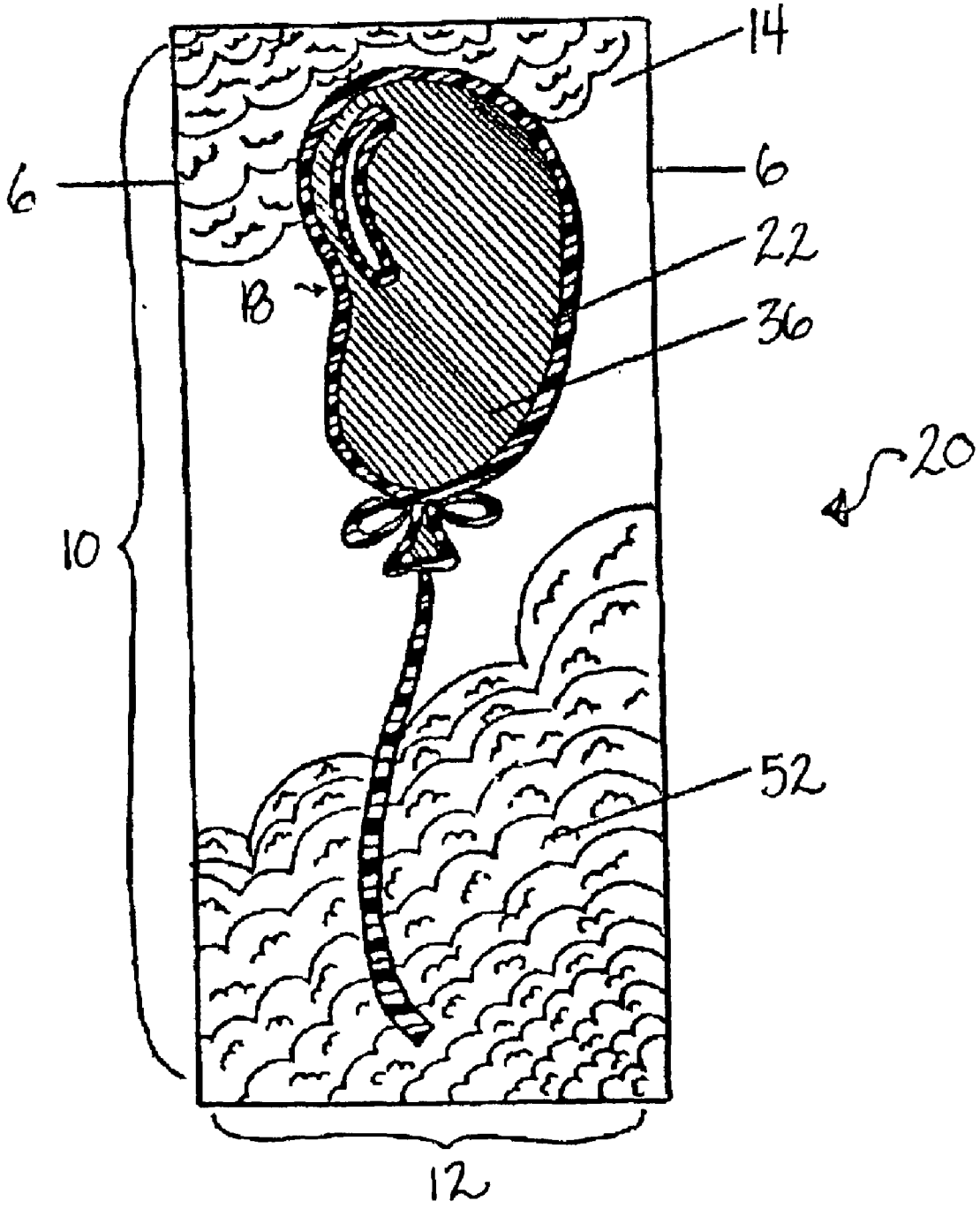
FIG. 4A is a top plan view of an etched plate in which two different types of cavities have been filled and the plate's surface painted, according to the present invention, with viscous phosphorescent paint.

FIG. 4A shows the plate 20 described in FIG. 3A, however, the image of clouds is added to the plate 20. The texture of the clouds is also added to the plate by lightly engraving, etching, or carving into the plate 20 and then filling those cavities with viscous phosphorescent paint 52. Alternatively, texture could be formed by applying viscous phosphorescent paint to the plate's surface 14, allowing the paint to dry, and then sanding the paint to different thicknesses.

As explained above, once the viscous phosphorescent paint 22, 36, & 52 is dry, the plate 20 is exposed to a light bulb causing the viscous phosphorescent paint layers 22, 36, & 52 to become light-emitting. When the light-emitting plate 20 is placed in contact with a photo-sensitive emulsion 90, the image on the plate 20 transfers to the photo-sensitive emulsion 90. The photo-sensitive emulsion 90 is then developed and becomes a print such as the print 54 as shown in FIG. 4B.

Figure 4B:
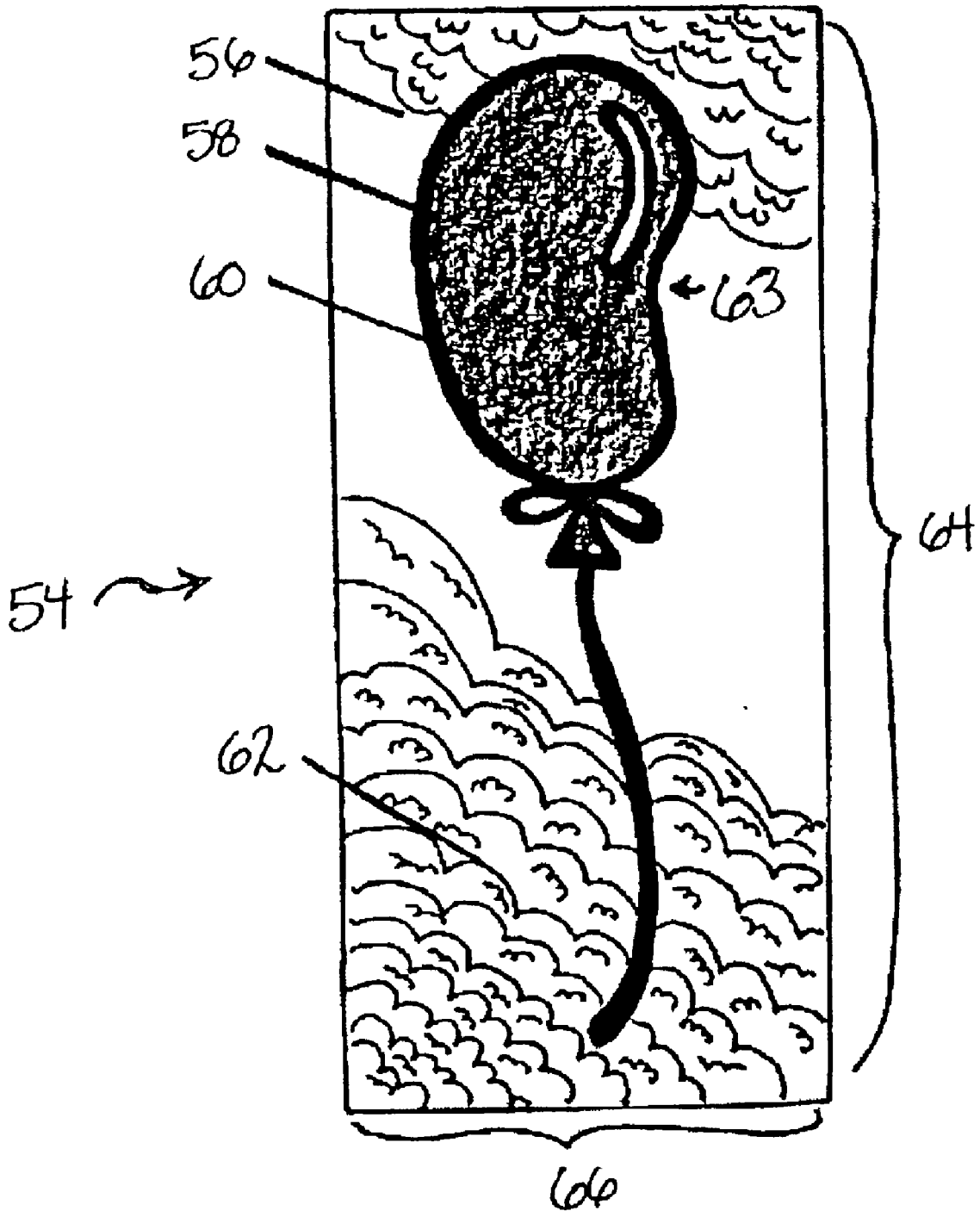
FIG. 4B is a top plan view of the print produced by the plate shown in FIG. 4A.

The print 54 shown in FIG. 4B contains a mirror image 63 of the balloon 18 found in FIG. 4A. The viscous phosphorescent paint 22 found in the plate's cavities 16 (see FIG. 4A) forms the black lines 58 of the print 54 found in FIG. 4B. Moreover, the plate's surface 14 surrounding the image 18, which contains no viscous phosphorescent paint 22, 36, & 52 (see FIG. 4A) creates the white background 56 of the print 54 as shown in FIG. 4B. Furthermore, the viscous phosphorescent paint found on the image's surface 36 (see FIG. 4A) produces the gray tone 60 of the print as shown in FIG. 4B. Finally, the viscous phosphorescent paint contained in the thinly etched lines 52 (see FIG. 4A) provides the texture 62 of the print 54 as shown in FIG. 4B.

Additionally, the area of the plate 20 and the area of the print 54 are identical. The vertical side 10 of the plate 20 (see FIG. 4A) is the same as the vertical side 64 of the print 54 (see FIG. 4B). Likewise, the horizontal side 12 of the plate 20 (see FIG. 4A) is the same as the horizontal side 66 of the print 54 as shown in FIG. 4B. Accordingly, the present invention will repeatedly produce identical black and white prints, with tonal variations, and a textured surface.

Figure 5A:
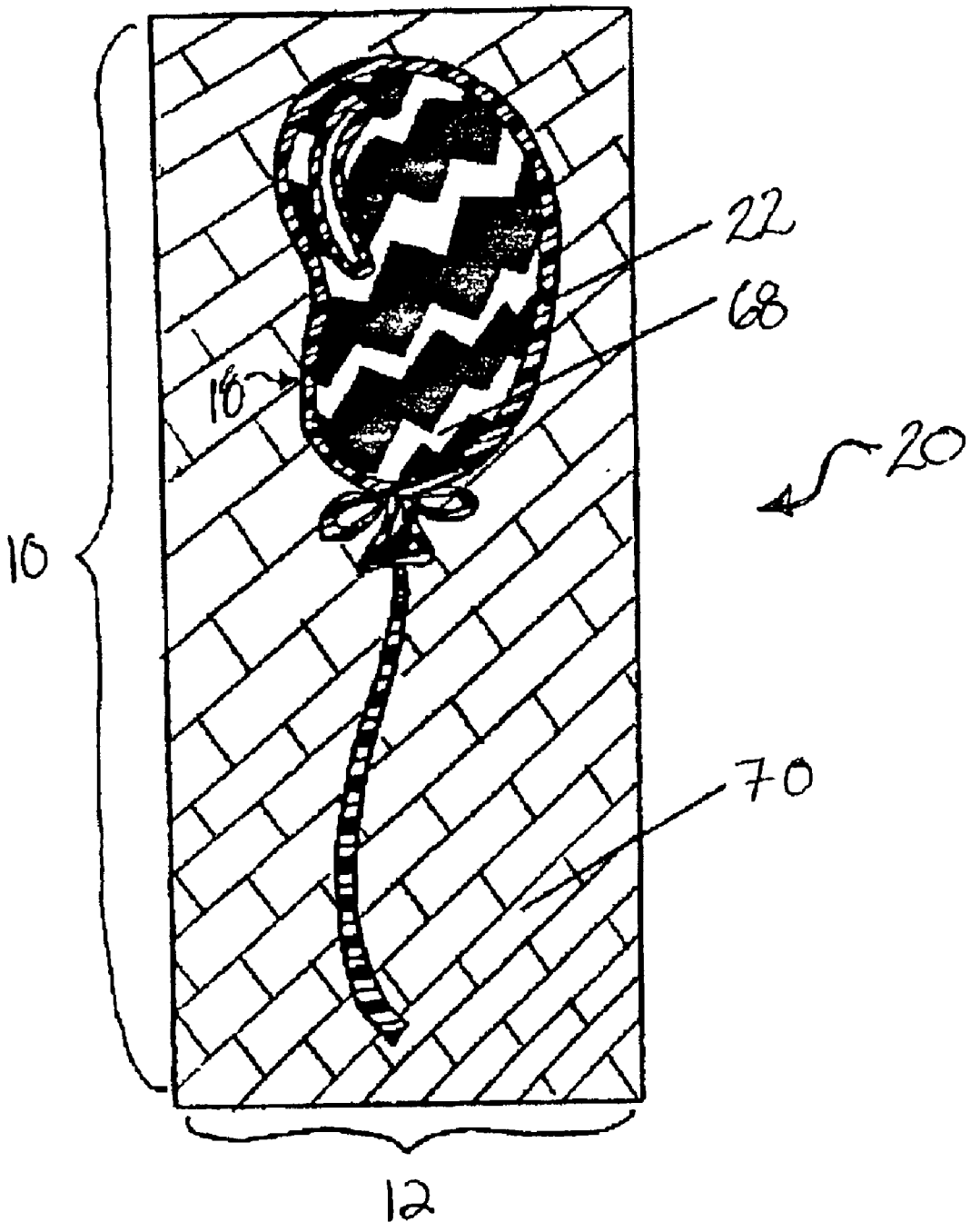
FIG. 5A is a top plan view of an etched plate in which the surface of the plate has been painted with colored acetate, and the cavities have been filled with viscous phosphorescent paint, according to the present invention.
Figure 5B:
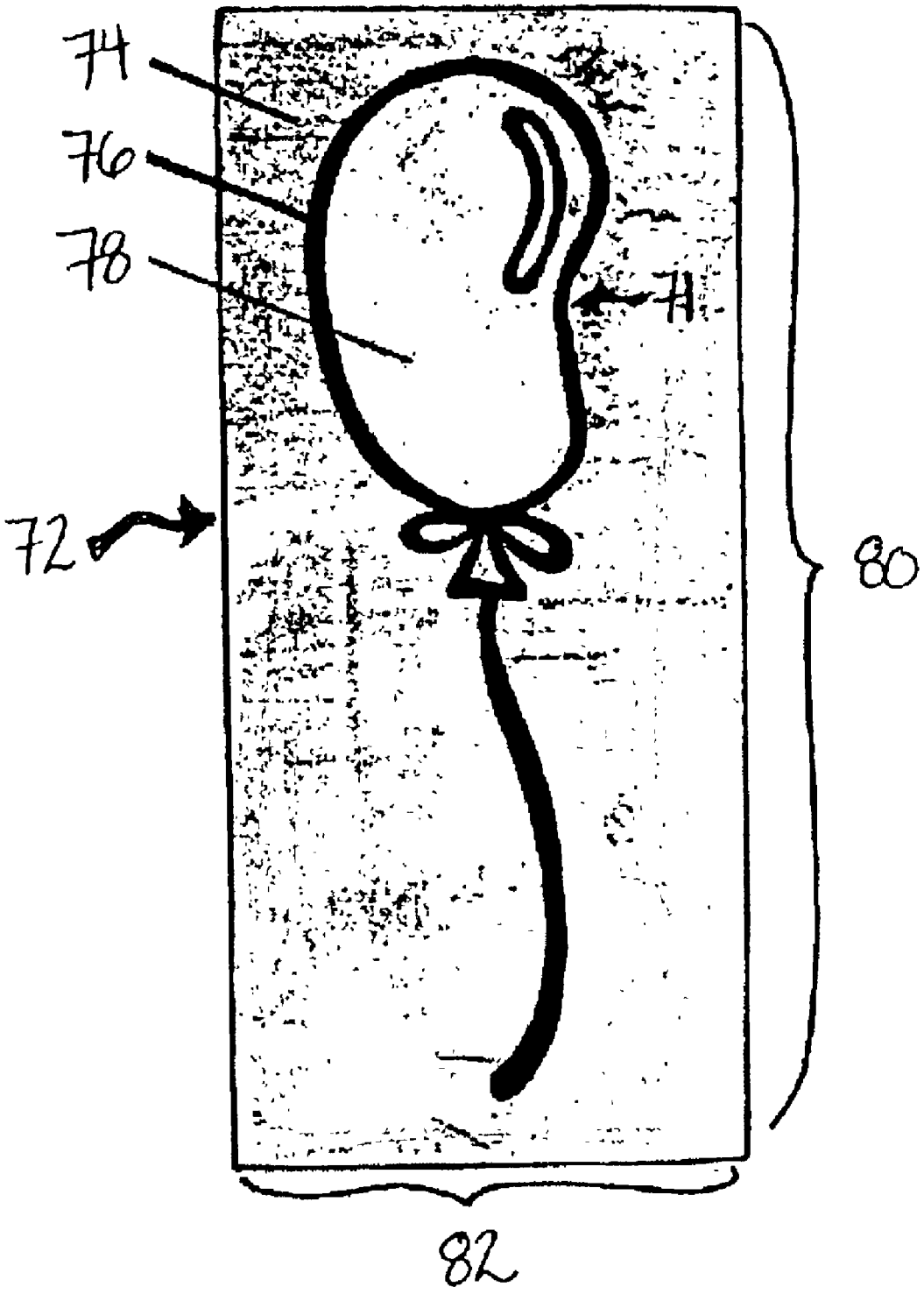
FIG. 5B is a top plan view of the print produced by the plate shown in FIG. 5A.

Furthermore, color prints can be achieved when producing a print 72, as shown in FIG. 5B, under the current invention by applying a thin layer of colored acetate 68 & 70 to a light, permanently transparent, water-resistant, thermoplastic plate 20. However, the colored acetate acts likes a colored photographic negative which produces not a true color representation, but the complement color in the positive image. Therefore, the colored acetate applied to the plate produces its complimentary color in the print. For example, if red acetate is applied to an image on the plate, the red acetate will produce its complementary color, green, in the print. Hence, the color of the image in the print will be green.

FIG. 5A represents a plate 20 which contains colored acetate 68 & 70. Specifically, FIG. 5A shows the plate 20 described in FIG. 2A, however, two thin layers of colored acetate 68 & 70 are glued or painted onto the plate's surface. The violet acetate 68 is added to the balloon 18, and the orange acetate 70 is added to the background of the balloon 14.

As explained above, once the viscous phosphorescent paint 22 and the colored acetate 68 & 70 are dry, the plate 20 is exposed to light causing the viscous phosphorescent paint layer 22 to become light-emitting. When the light-emitting plate 20 is placed in contact with the photo-sensitive emulsion 90, the image on the plate 20 transfers to the photo-sensitive emulsion 90. Furthermore, the colored acetate layers 68 & 70 transfer their complimentary colors on the photo-sensitive emulsion 90. Therefore, the violet acetate 68 becomes the color yellow on the photo-sensitive emulsion 90, and the orange acetate 70 becomes the color blue on the photo-sensitive emulsion 90. The photo-sensitive emulsion 90 is then developed according to traditional color photo-developing instructions and produces a print such as the print 72 as shown in FIG. 5B.

FIG. 5B shows a resulting print 72 that is created by the plate 20 shown in FIG. 5A. The print 72 contains a mirror image 71 of the balloon 18 found in FIG. 5A. The viscous phosphorescent paint 22 found in the plate's cavities 16 (see FIG. 5A) forms the black lines 76 of the print 72 found in FIG. 5B. Moreover, the violet acetate 68 found on the balloon's surface 68 (see FIG. 5A) produces the yellow balloon image 78 in the print 72 as shown in FIG. 5B. Finally, the plate's surface 14 surrounding the image 18, which contained the orange acetate 70, (see FIG. 5A) creates the blue background 74 of the print 72, as shown in FIG. 5B.

In addition, the area of the plate 20 and the area of the print 72 are identical. The vertical side 10 of the plate 20 (see FIG. 5A) is the same as the vertical side 80 of the print 72, (see FIG. 5B). Likewise, the horizontal side 12 of the plate 20 (see FIG. 5A) equals the horizontal side 82 of the print 72 (see FIG. 5B). Accordingly, the present invention can produce and reproduce identical, color prints.

Figure 6A:
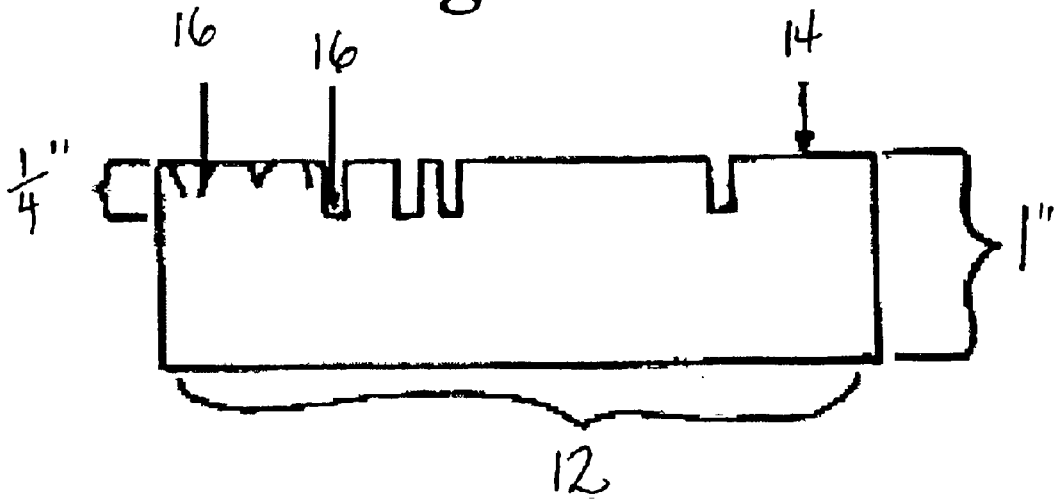
FIG. 6A is a cross-sectional view of the plate as shown in FIG. 4A taken through line 6–6' before the application of viscous phosphorescent paint.

FIG. 6A represents a cross-sectional view of the plate 20 shown in FIG. 4A, taken through line 6–6', before the application of viscous phosphorescent paint 22, 36, & 52. FIG. 6A shows that the depth of the plate's cavities 16 preferably will not exceed 0.2500 inches. Moreover, FIG. 6A illustrates the difference between a cavity 16 that produces a bold black line and a cavity 16 that produces a thin, textured line.

Figure 6B:
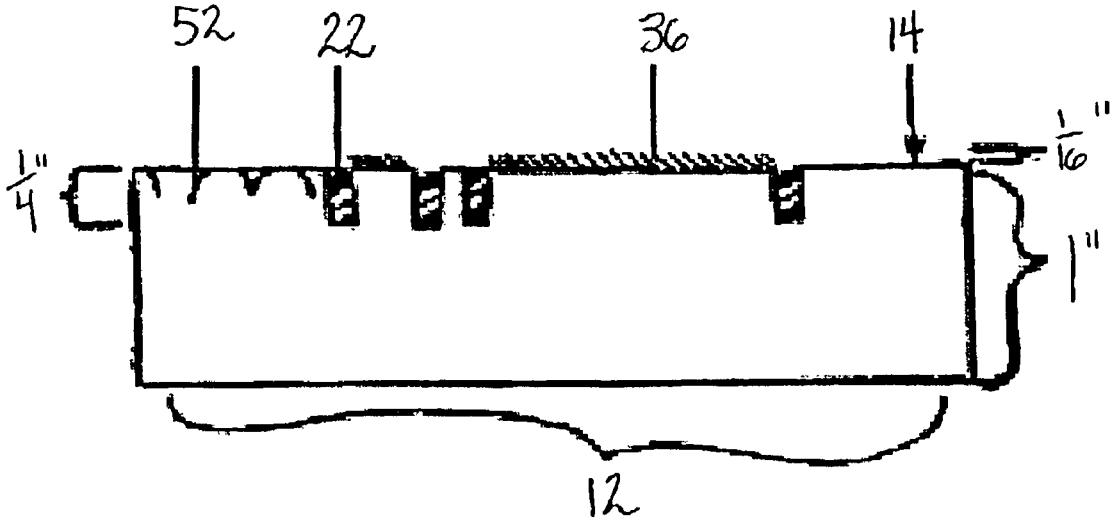
FIG. 6B is a cross-sectional view of the plate as shown in FIG. 4A taken through line 6–6' after the application of viscous phosphorescent paint.

FIG. 6B represents a cross-sectional view of the plate 20 as shown in FIG. 4A, taken through line 6–6', after the application of viscous phosphorescent paint 22, 36, & 52. FIG. 6B shows how the viscous phosphorescent paint 22 & 52 fills the plate's cavities 16 and becomes part of the plate 20. Furthermore, FIG. 6B illustrates that the viscous phosphorescent paint layer 36 on the plate's surface 14 preferably will not exceed more then 0.0625 inches.

Figure 7:
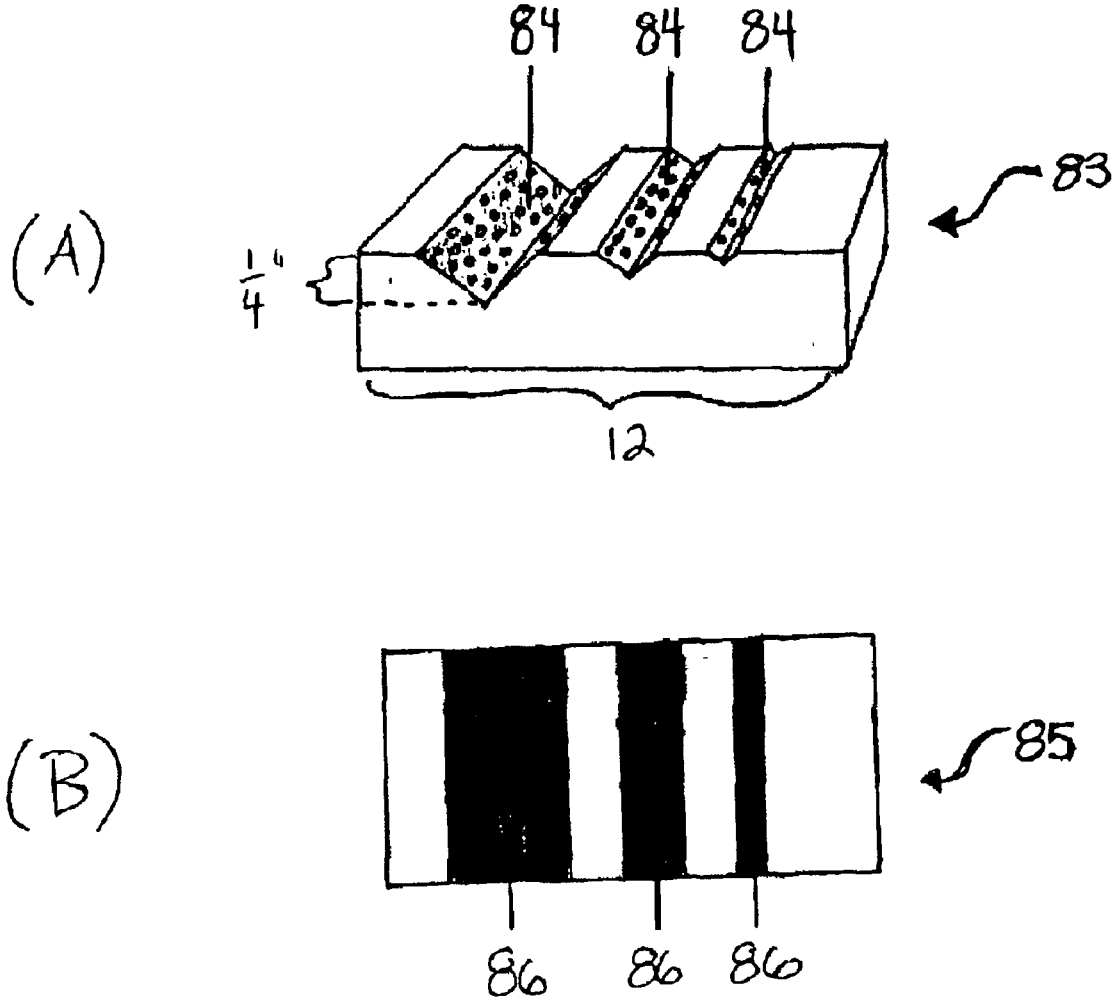
FIG. 7A is schematic cross-sectional view of a plate containing three cavities that vary in depth and width.
FIG. 7B is a top plan view of the print produced by the plate shown in FIG. 7A.

FIG. 7A is a schematic cross-sectional view of a plate 83 which shows that the depth and width of a plate's cavities 16 can vary.

FIG. 7B represents the print 85 produced by FIG. 7A. Furthermore, FIG. 7B shows that there is a direct correlation between the volume of the cavity 84, and the thickness of the black line 86 that cavity produces. In essence, the greater the volume of the cavity 84, the thicker the black line 86 that cavity produces on the print 85.

As previously mentioned, FIG. 8 shows that a hinged device 88 can be used when making prints according to the present invention. The hinged device 88 ensures that the light-emitting plate 20 is not prematurely exposed to the photo-sensitive emulsion 90. Consequently, the hinged device 88 guarantees that blurring of the print does not occur.

It will be apparent to those skilled in the art that various modifications and variations can be made in the method and system of the present invention without departing from the spirit or scope of the invention. For example, publishers or free-lance artists may use the concepts of this invention and create books formed from double-sided prints. Thus, the present invention is not limited by the foregoing descriptions but is intended to cover all modifications and variations that come within the scope of the spirit of the invention and the claims that follow.

What is claimed is:

1. A method of printmaking comprising:

providing a plate having a surface including cavities forming an image;

applying a coating of viscous phosphorescent paint over said surface of said plate;

adding layers of phosphorescent paint to said surface;

exposing said plate to light;

placing said plate in contact with a photo-sensitive emulsion; and developing said photo-sensitive emulsion, producing a finished print.

2. A method of printmaking according to claim 1, wherein said plate is wood.

3. A method of printmaking according to claim 1, wherein said plate is metal.

4. A method of printmaking according to claim 1, wherein said plate is stone.

5. A method of printmaking according to claim 1, wherein said plate is transparent, water-resistant thermoplastic.

6. A method of printmaking according to claim 1, further comprising etching said cavities into said plate's surface.

7. A method of printmaking according to claim 1, further comprising engraving said cavities into said plate's surface.

8. A method of printmaking according to claim 1, further comprising carving said cavities into said plate's surface.

9. A method of printmaking according to claim 1, wherein said photo-sensitive emulsion is photographic paper.

10. A method of printmaking according to claim 1, wherein said photo-sensitive emulsion is liquid-photographic emulsion.

11. A method of printmaking according to claim 1, further comprising painting liquid colored acetate onto said plate's surface.

12. A method of printmaking according to claim 1, further comprising gluing solid colored acetate onto said plate's surface.

13. A print, comprising:

a developed photo-sensitive emulsion which has been exposed to a plate containing an image formed by applying layers of light-emitting viscous phosphorescent paint to said plate's surface.

14. A print according to claim 13, wherein said print is a black and white print.

15. A print according to claim 14, wherein said print contains tonal variations.

16. A print according to claim 14, wherein said print contains tonal variations and texture.

17. A print according to claim 13, wherein said print is a monochromatic print.

18. A print according to claim 13, wherein said print is a color print.

19. A print according to claim 13, wherein said photo-sensitive emulsion is photographic paper.

20. A print according to claim 13, wherein said photo-sensitive emulsion is liquid-photographic emulsion.

21. A method of printmaking comprising:

providing a plate having a surface including cavities forming an image;

applying a coating of viscous phosphorescent paint over said surface of said plate;

removing layers of phosphorescent paint from said surface;

exposing said plate to light;

placing said plate in contact with a photo-sensitive emulsion; and developing said photo-sensitive emulsion, producing a finished print.

22. A method of printmaking comprising:

providing a plate having a surface including cavities forming an image;

applying a coating of viscous phosphorescent paint over said surface of said plate;

painting liquid colored acetate onto said plate's surface;

exposing said plate to light;

placing said plate in contact with a photo-sensitive emulsion; and developing said photo-sensitive emulsion, producing a finished print.

23. A method of printmaking according to claim 22, further comprising adding layers of phosphorescent paint to said surface.

24. A method of printmaking according to claim 22, further comprising removing layers of phosphorescent paint from said surface.

25. A method of printmaking comprising:

providing a plate having a surface including cavities forming an image;

applying a coating of viscous phosphorescent paint over said surface of said plate;

gluing solid colored acetate onto said plate's surface;

exposing said plate to light;

placing said plate in contact with a photo-sensitive emulsion; and developing said photo-sensitive emulsion, producing a finished print.

26. A method of printmaking according to claim 25, further comprising adding layers of phosphorescent paint to said surface.

27. A method of printmaking according to claim 25, further comprising removing layers of phosphorescent paint from said surface.

* * * * *